United States Patent [19]

Gilroy et al.

[11] Patent Number: 4,955,096

[45] Date of Patent: Sep. 11, 1990

[54] ANATOMICALLY CONTOURED CONVOLUTED FOAM PAD

[75] Inventors: Keith Gilroy, Upland; Gary T. Limon, San Dimas; David F. Buchicchio, Glendora, all of Calif.

[73] Assignee: Bio Clinic Corporation, Rancho Cucamonga, Calif.

[21] Appl. No.: 372,911

[22] Filed: Jun. 28, 1989

[51] Int. Cl.[5] ..... A47C 27/14

[52] U.S. Cl. ..... 5/464; 5/481

[58] Field of Search ..... 5/481, 464, 448, 420; 297/DIG. 1

[56] References Cited

U.S. PATENT DOCUMENTS

| | | | |
|---|---|---|---|
| 2,659,418 | 11/1953 | Berman | 5/481 |
| 3,258,791 | 7/1966 | Kaplan | 5/481 |
| 3,512,190 | 5/1970 | Buff | 5/481 |
| 3,828,378 | 8/1974 | Flam | 5/464 |
| 4,042,987 | 8/1977 | Rogers | 5/481 |
| 4,070,719 | 1/1978 | Morgan | 5/481 |
| 4,092,751 | 6/1978 | Burkholder et al. | 5/464 |
| 4,110,881 | 9/1978 | Thompson | 5/481 |
| 4,603,445 | 8/1986 | Spann | 5/481 |
| 4,620,337 | 11/1986 | Williams et al. | 5/464 |
| 4,673,452 | 6/1987 | Awdhan | 5/481 |
| 4,700,447 | 10/1987 | Spann | 5/481 |
| 4,741,058 | 5/1988 | Williams et al. | 5/468 |
| 4,768,251 | 9/1988 | Baskent | 5/468 |

*Primary Examiner*—Alexander Grosz

*Attorney, Agent, or Firm*—Christie, Parker & Hale

[57] ABSTRACT

A foam pad containing slits in its upper surface is disclosed. In its preferred embodiment the pad is adapted to be positioned on a bed in a supporting relationship to a patient. The pad has head and foot supporting sections, each in the form of a convoluted checkerboard pattern of rows of peaks separated by depressions. A torso supporting section is located between the head and foot supporting sections comprising substantially parallel ribs separated by substantially parallel valleys. The slits are located on the torso supporting section, transverse to the ribs, forming a diamond-shaped area. Each slit varies in depth decreasing from the center of the pad towards the sides of the pad. Additionally, the overall depth of the slits is progressively shallower towards the head and foot supporting sections of the pad. In another embodiment, slits of the same configuration are used with a pad having a smooth upper surface which supports at least a portion of a body. The configuration of the slits cause the pad to be softer permitting the bony prominences of the body in contact with the slits, to sink deeper into the pad than other portions of the body. This substantially reduces the pressure placed on the skin covering these bony prominences thereby helping to prevent the formation of decubitus ulcers.

10 Claims, 3 Drawing Sheets

ANATOMICALLY CONTOURED CONVOLUTED FOAM PAD

FIELD OF THE INVENTION

The present invention relates generally to convoluted support pads adapted for supporting the human body and in particular to a supporting pad containing slits which aids in the prevention of the formation of decubitus ulcers on the skin covering the bony prominences of the body

BACKGROUND OF THE INVENTION

Convoluted foam body-supporting pads are well known. One such pad is illustrated in U.S. Pat. No. 4,741,058 which discloses a body-supporting pad comprising three sections. The first section, adapted for supporting the head, and the third section, adapted for supporting the legs and feet, have convoluted supporting surfaces of peaks and depressions of varying heights and depths forming a checkerboard pattern. A second section located between the first and third sections, adapted for supporting the torso region, has a ribbed convoluted supporting surface. Other pads are known which support only a portion of the body in a supine or sitting position. For example, U.S. Pat. No. 3,693,619 discloses a pad adapted to support a patient's heel.

The above-described and other similar foam pads, when used on bed ridden patients, have enjoyed success in helping to reduce the formation of decubitus ulcers by reducing pressure on the skin which would otherwise occur when lying on a standard hospital mattress

SUMMARY OF THE INVENTION

It has been discovered that the pressure relief capability of such pads can be enhanced if the pads are slit at various depths to further reduce support pressure on prominent areas of the body. For example, the torso supporting section of the aforesaid convoluted bed pads may be slit at various depths to reduce support pressure in the sacral/coccygeal area in the supine position and in the trochanteric region in the side-lying position When used as a bed pad the present invention comprises a head supporting section, a torso supporting section and a foot and leg supporting section. The head supporting section and the foot and leg supporting section are each adjacent to one of the two pad ends and each have a convoluted supporting surface of adjacent rows of peaks separated by depressions. The rows of peaks extend transversely across the width and longitudinally across the length of said sections. Alternate rows of peaks are staggered in both the transverse and longitudinal directions to form a checkerboard pattern of peaks and depressions.

The torso supporting section is located between the head and foot supporting sections and is comprised of a convoluted supporting surface of substantially parallel ribs separated by substantially parallel valleys. The ribs and valleys extend longitudinally on the pad between the head and foot supporting sections. The torso supporting section additionally has a plurality of slits in the ribs and valleys The depth of each slit varies both relative to the other slits and along its length. The deepest slit is the center slit. The relative depth of each of the remaining slits decreases towards the head and foot ends of the pad. The depth of each slit is greatest for that portion of the slit which is in the center of the pad. The depth of each slit then decreases as the slit extends towards the edges of the pad, terminating when the bottom of the slit reaches the surface of the pad.

The area containing the slits permits the bony prominences of the sacrum and trochanter portions of the pelvic area, when placed centrally thereon, to sink into the pad. This provides relief from pressure on the pelvic area, thereby reducing the formation of decubitus ulcers on that portion of the anatomy.

In another embodiment of the invention the pad is of a sufficient size to support prominent portions of the body such as the head, foot, buttocks and the like. The upper surface of the pad comprises slits of the same configuration as in the preferred embodiment for a bed pad. The area of the pad containing the slits permits these other prominent body parts, when placed centrally thereon, to sink into the pad. This provides relief from pressure on the skin covering these areas, thereby reducing the formation of decubitus ulcers

DETAILED DESCRIPTION

When used as a bed pad, a preferred embodiment of the invention comprises a pad having a length and width sufficient to support the human body. The pad is preferably made from a polyurethane open-cell foam with a density of from about 1 to about 5 lbs/ft$^3$ and is adapted to be placed on a hospital bed. The pad has a length of approximately 6 feet, a width of approximately 3 feet, and a thickness which varies along the length from about 3.25 to about 4.5 inches. The thickness variation of the pad is described in greater detail below.

Figure 1:
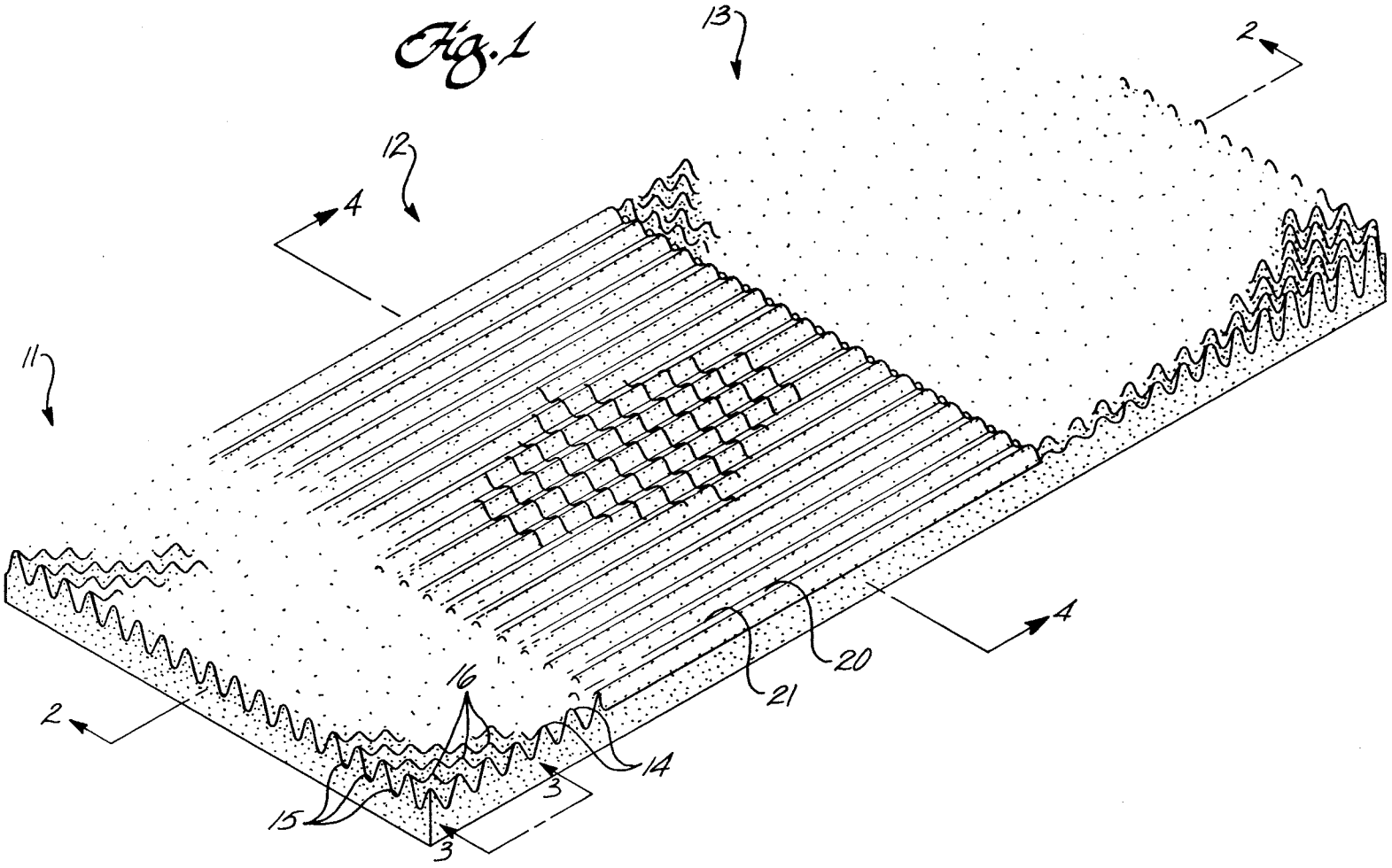
FIG. 1 is a top perspective view of a preferred embodiment of the present invention, when used as a bed pad, wherein a partial perspective view is used to illustrate the head supporting section, and the foot and leg supporting section.

Referring to FIG 1, the pad comprises three distinct sections: a head supporting section 11 having a length of approximately 1 foot; a torso supporting section 12 having a length of approximately 3 feet; and a leg and foot supporting section 13 having a length of approximately 2 feet.

Figure 3:
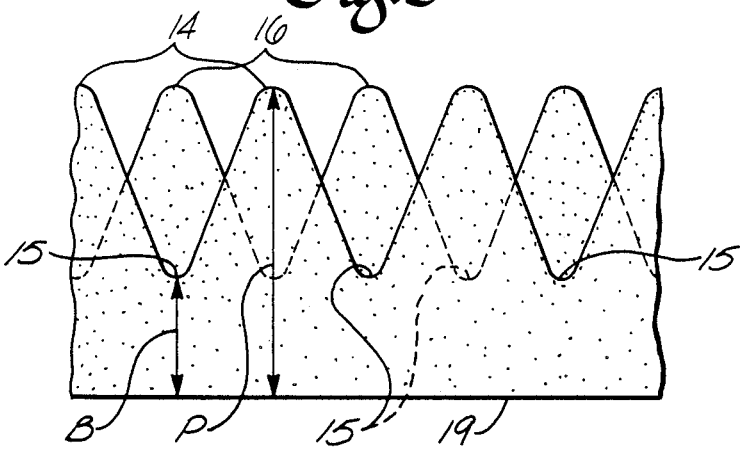
FIG. 3 is a partial side elevation view along line 3—3 of the embodiment of the invention shown in FIG. 1.

As seen in FIGS. 1 & 3 the head supporting section 11 comprises a plurality of adjacent rows of peaks 14 and 16. The peaks extend in adjacent rows transversely across the width of the pad and longitudinally along the length of the pad from the head end to the torso supporting section 12. Peaks 14 and 16 are separated from each other by depressions 15. The rows of peaks 14 are staggered in relation to the rows of peaks 16 both transversely and longitudinally to form a checkerboard pattern.

Figure 2:
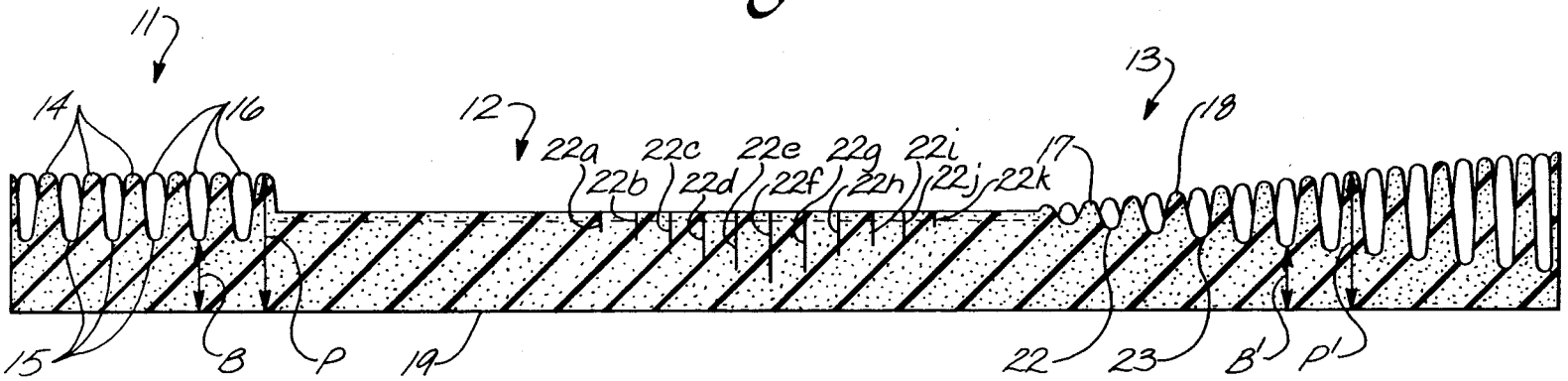
FIG. 2 is a cross sectional view taken along line 2—2 of the embodiment of the invention shown in FIG. 1.

As shown in FIGS. 2 & 3, the distance from the bottom surface 19 of the pad to the bottom of any depression 15 comprises base height B. The distance from the bottom surface 19 of the pad to the tip of any peak 14 and 16 comprises the peak height P. The heights of P and B and thus the sum (P+B) for any peak and depression are constant throughout the head supporting section. In the presently preferred embodiment the peak height is about 3.75 inches and base height is about 2.25 inches.

Referring now to FIG. 2, the leg and foot supporting section 13 of the pad is also comprised of a plurality of adjacent staggered rows of peaks separated by depressions forming a checkerboard pattern. The peak height P' increases, while the depression base height B' decreases, along the leg and foot supporting section from the torso supporting section 12 to the foot end of the pad. Thus, peak 18 has a height which is greater than the height of peak 17, while depression 23 has a base height less than the base height of depression 22. Along the leg and foot supporting section, the amount of increase of peak height P' equals the amount of decrease of the depression base height B'. Thus sum of the adjacent peak heights and depression base heights (P'+B') remain constant. For example, the sum of the peak height for peak 17 plus the base height of depression 22 is equal to the sum of the peak height of peak 18 and the base height of depression 23. In the presently preferred embodiment of the invention, immediately adjacent to the torso supporting section the peak height is about 3.25 inches while the base height is about 2.75 inches. At the foot end of the pad the peak height is about 4.5 inches and the base height is about 1.5 inches.

Figure 4:
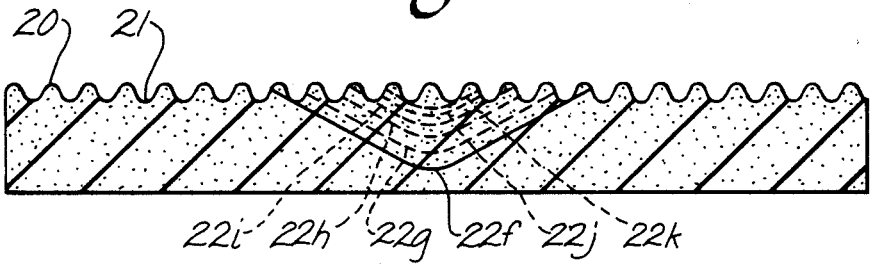
FIG. 4 is a cross sectional view taken along line 4—4 of the embodiment of the invention shown in FIG. 1.

As seen in FIGS. 1 and 4, the torso supporting section 12 comprises a ribbed surface pattern of substantially parallel ribs 20 separated by substantially parallel valleys 21. In the preferred embodiment of the invention, the rib peak height is about 3.25 inches while the valley height is about 2.75 inches. The distance separating immediately adjacent ribs is about 2 inches The torso supporting section has lateral slits 22 in the ribbed convoluted supporting surface. There are a total of eleven slits *22a–22k*, spaced about 2 inches apart in the preferred embodiment of the invention. The center slit *22f*, which is the longest of the slits, is about 14 inches in length and is located about 40 inches from the foot end of the pad, The slits preferably define a diamond-shaped area. Each slit is cut progressively shorter and shallower towards the head supporting and leg and foot supporting sections of the pad. The bottom center portion of the center slit *22f* has a depth of about 2.5 inches below the top surface of the ribs 21, while the depth of the bottom center portion of the end slits *22a* and *22k*, those closest to the head supporting and the leg and foot supporting sections of the pad, is about 0.75 inches.

The slits additionally vary in depth across their length. Each slit is cut such that its depth becomes shallower from the center of the pad towards the sides of the pad In the preferred embodiment of the invention, each slit angles up about 20° from its center portion, terminating when the bottom of the slit reaches the surface of the pad.

Figure 5:
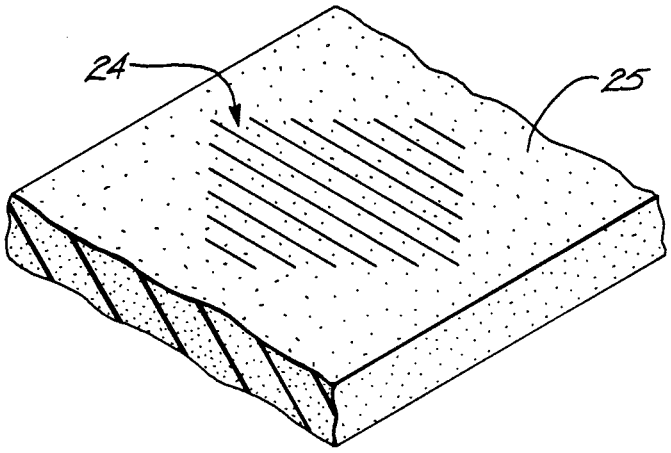
FIG. 5 is a partial top perspective view of another embodiment of the invention, when used to support specific prominent areas of the body.

In another embodiment of the invention, shown in FIG. 5, the pad is of a size sufficient size for supporting at least part of a human body. The pad comprises a plurality of slits 24 in its upper surface 25. The upper surface is smooth but may be convoluted or ribbed. The slits are configured in the same manner as in the preferred embodiment The pad may be used to support the full body as a bed pad. The pad may also be used to support a portion of the body as a head pad, a heel pad, a pad to sit on, or as a pad for any anatomical part where it is desired to remove pressure on any prominent body part.

In both embodiments the slits cause the section of the pad to be softer in the area containing the slits than the area surrounding the slits. The increased softness permits the bony prominences of the sacrum and the trochanter, or other portions of the body in contact with the slits, to sink deeper into the pad than the surrounding portions of the body. This substantially reduces the pressure placed on the skin covering these bony prominences thereby helping to prevent the formation of decubitus ulcers thereon.

Although two embodiments of the present invention have been described above and illustrated in the drawings, it will be appreciated that a variety of equivalents may be substituted for the elements described and shown. For example, the height of the peaks and depressions in the various sections of the preferred embodiment and the depth of the slits in either embodiment may be varied depending upon the thickness of the pad, the density of the foam, the weight of the person using the pad as well as the particular application. There may be more or less than eleven slits spaced more or less than two inches apart. The slits may be cut to define a square, rectangular, oval or circular shaped area. The slits may be cut perpendicular or parallel to the edges of the pad or some angle in between. The angle at which the bottom of the slits rise to the surface of the pad may be other than 20°. The pad may be made from materials other than polyurethane foam. Accordingly, the above description should not be used to limit the scope of the invention which is defined in the appended claims.

What is claimed is:

1. An anatomically contoured pad of a size sufficient for a human body on a bed, pad being el between two pad ends and having a and lower surface, the upper surface comprising;

a head supporting section, and a foot and leg supporting section, each adjacent to one of the two pad ends and each having a convoluted supporting surface of adjacent rows of peaks separated by depressions, the rows of peaks extending transversely across the width of each section and longitudinally along the length of each section with alternate rows of peaks being staggered in both the transverse and longitudinal directions to form a checkerboard pattern; and a torso supporting section intermediate the head and foot supporting sections comprising a ribbed convoluted supporting surface having substantially continuous and parallel ribs separated by substantially continuous and parallel valleys extending longitudinally between the head and foot supporting sections, and a plurality of slits in said ribbed convoluted supporting surface wherein the slits are perpendicular to the ribs, with the depth of the center slit being greatest and the relative depth of each of the remaining slits being progressively shallower towards the head and foot ends of the pad and with the depth of each slit being greatest for that portion of the slit in the center portion of the pad and the depth of each slit being progressively shallower towards the edges of the pad.

2. The pad of claim 1 wherein the area containing said slits is a diamond shape.

3. The pad of claim 1 wherein the area containing said slits is a square shape.

4. The pad of claim 1 wherein the area containing said slits is a circular shape.

5. An anatomically contoured pad of a size sufficient for supporting a human body on a bed, the pad being elongated between two pad ends and having an upper and lower surface, the upper surface comprising;

a head supporting section, and a foot and leg supporting section, each adjacent to one of the two pad ends and each having a convoluted supporting surface of adjacent rows of peaks separated by depressions, the rows of peaks extending transversely across the width of each section and longitudinally along the length of each section with alternate rows of peaks being staggered in both the transverse and longitudinal directions to form a checkerboard pattern; and a torso supporting section intermediate the head and foot supporting sections comprising a ribbed convoluted supporting surface having substantially continuous and parallel ribs separated by substantially continuous and parallel valleys extending longitudinally between the head and foot supporting sections;

the torso supporting section having a plurality of slits in the ribbed convoluted supporting surface, the slits being perpendicular to the ribs, the depth of the center slit being the deepest of all said slits and the relative depth of each of the remaining slits being progressively shallower towards the head and foot ends of the pad, the depth of each slit being the greatest for that portion of the slit in the center portion of the pad and the depth of each slit becoming progressively shallower towards the edges of the pad said slits being approximately 2 inches apart, said center slit being approximately 14 inches in length and located approximately 40 inches from the foot end of the pad.

6. The pad of claim 5 wherein said slits are eleven in number and form the shape of a diamond on the top surface of said pad.

7. The pad of claim 5 wherein the pad comprises a foam material.

8. The pad of claim 7 wherein the foam comprises polyurethane.

9. The pad of claim 8 wherein the polyurethane foam has an open cell construction.

10. The pad of claim 7 wherein the foam has a density in the range of about 1 to about 5 lbs/ft$^3$.

* * * * *

UNITED STATES PATENT AND TRADEMARK OFFICE

CERTIFICATE OF CORRECTION

PATENT NO. : 4,955,096

DATED : September 11, 1990

INVENTOR(S) : K. Gilroy; G.T. Limon; D.F. Buchicchio

It is certified that error appears in the above-identified patent and that said Letters Patent is hereby corrected as shown below:

On the Front Page:

[73] Assignee; delete "Rancho Cucamonga" and insert -- Ontario --.

Column 1, line 29, change "bed ridden" to -- bedridden --.
Column 1, line 62, after "valleys" insert a period.

Column 2, line 18, after "ulcers" insert a period.

Column 3, line 37, after "inches" insert a period.
Column 3, line 44, after "pad" and before "The" change the comma to a period.
Column 3, line 53, after "0.75" change "inches" to -- inch --.
Column 3, line 62, after "sufficient" and before "for" delete "size".
Column 3, line 67, after "embodiment" and before "The" insert a period.

In the Claims

Column 4, line 38, after "for" and before "a" insert -- supporting --.
Column 4, line 38, after "bed," and before "pad" insert -- the --.

UNITED STATES PATENT AND TRADEMARK OFFICE

CERTIFICATE OF CORRECTION

PATENT NO. : 4,955,096

DATED : September 11, 1990

INVENTOR(S) : K. Gilroy; G.T. Limon; D.F. Buchicchio

It is certified that error appears in the above-identified patent and that said Letters Patent is hereby corrected as shown below:

Column 4, line 38, after "being" and before "between" delete "el" and insert -- elongated --.

Column 4, line 39, after "having" and before "and" delete "a" and insert -- an upper --.

Signed and Sealed this

Nineteenth Day of May, 1992

*Attest:*

DOUGLAS B. COMER

*Attesting Officer*

*Acting Commissioner of Patents and Trademarks*